US009217342B2

(12) United States Patent
Eisenbacher

(10) Patent No.: US 9,217,342 B2
(45) Date of Patent: Dec. 22, 2015

(54) COLLECTING CONTAINER FOR LUBRICANTS

(75) Inventor: Egon Eisenbacher, Karlstadt (DE)

(73) Assignee: PERMA-TEC GMBH & CO. KG, Euerdorf (DE)

( * ) Notice: Subject to any disclaimer, the term of this patent is extended or adjusted under 35 U.S.C. 154(b) by 0 days.

(21) Appl. No.: 14/343,857

(22) PCT Filed: Aug. 17, 2012

(86) PCT No.: PCT/EP2012/066103

§ 371 (c)(1),
(2), (4) Date: Apr. 10, 2014

(87) PCT Pub. No.: WO2013/053516

PCT Pub. Date: Apr. 18, 2013

(65) Prior Publication Data

US 2014/0224837 A1 Aug. 14, 2014

(30) Foreign Application Priority Data

Oct. 14, 2011 (DE) ..... 20 2011 051 640 U

(51) Int. Cl.
*B65D 35/28* (2006.01)
*F01M 11/04* (2006.01)

(52) U.S. Cl.
CPC ..... *F01M 11/0458* (2013.01)

(58) Field of Classification Search
CPC ..... F01M 11/04; F01M 11/0458; F01M 11/0483; F01M 2011/0483; F01M 2011/0486
USPC ..... 222/95, 100, 105, 368, 368.5, 388; 184/37, 14, 7, 26, 5.1, 6.4, 106, 7.2, 184/7.3, 45.1, 105.1; 141/313–317
See application file for complete search history.

(56) References Cited

U.S. PATENT DOCUMENTS

| | | | | |
|---|---|---|---|---|
| 5,337,925 | A * | 8/1994 | Ferrara, Jr. | 222/214 |
| 5,902,362 | A * | 5/1999 | Paoluccio | 55/418 |
| 6,101,968 | A * | 8/2000 | Fitzgibbons et al. | 118/14 |
| 6,158,621 | A * | 12/2000 | Keller | 222/95 |
| 6,431,411 | B1 * | 8/2002 | Wenner | 222/386 |
| 7,510,396 | B2 * | 3/2009 | Lee et al. | 433/125 |
| 2002/0067398 | A1 * | 6/2002 | Shyn et al. | 347/86 |
| 2010/0181327 | A1 * | 7/2010 | Kanda et al. | 220/601 |
| 2012/0103465 | A1 | 5/2012 | Paluncic | |

FOREIGN PATENT DOCUMENTS

| | | | |
|---|---|---|---|
| FR | 2726627 | A | 5/1996 |
| JP | 60159500 | A | 8/1985 |

* cited by examiner

*Primary Examiner* — Lien Ngo
(74) *Attorney, Agent, or Firm* — Andrew Wilford

(57) ABSTRACT

The invention relates to a collecting container for lubricants having a housing (1) which has an inlet opening (2) for introducing lubricant (3) and is open on the opposite side, and having a flexible membrane (4) which is fastened to the housing (1) and which delimits a lubricant collecting chamber (5) adjoining the inlet opening (2) in the housing (1). According to the invention the membrane (4) has, starting from the point where it is fastened to the housing (1), firstly a bellows section (6) and a reinforced section (7) connected at the end thereof.

11 Claims, 2 Drawing Sheets

COLLECTING CONTAINER FOR LUBRICANTS

CROSS REFERENCE TO RELATED APPLICATIONS

This application is the US-national stage of PCT application PCT/EP2012/066103 filed 17 Aug. 2012 and claiming the priority of German patent application 202011051640.7 itself filed 14 Oct. 2011.

FIELD OF THE INVENTION

The invention relates to a collecting container comprising a housing that is formed with an inlet port to introduce lubricant and is open on the opposite end, and comprising a flexible membrane that is attached to the housing, which membrane delimits a lubricant collection chamber adjacent the inlet port.

BACKGROUND OF THE INVENTION

Contaminated and excess lubricant in lubricant systems in which, for example, a bearing is supplied with lubricant is often captured and collected in reusable collecting containers that are connected to the outlet of a bearing. A collecting container for lubricants having the above-referenced purpose and the above-described features has been disclosed in DE 20 2010 014 823 [US 2012/0103465]. In the known collecting container, an elastic membrane that delimits and seals the lubricant collection chamber is displaced by the inflowing lubricant. At the same time, air present in the collecting container escapes through a vent provided in a cover closing the collecting container. Once the collecting container is filled completely, the membrane rests against the bottom of the cover. The disadvantage here is that it is impossible, or is possible only with great effort, to then empty the collecting container.

OBJECT OF THE INVENTION

In response to the situation described above, the object of the invention is to provide a reusable collecting container for lubricants that is sealed effectively and can be emptied by simple means.

SUMMARY OF THE INVENTION

The object of the invention and achievement of this object is a collecting container for lubricants in which the membrane starting from its attachment to the housing first has a bellows section and a reinforced section connected to the end thereof. The reinforced section forms a surface whose face near the inlet port is in contact with the lubricant after the lubricant collection chamber has been filled. This surface distributes the force to be applied to empty the collecting container across the lubricant, and this provides uniform ejection and enables the lubricant container to be emptied completely. In addition, the reinforced surface is robust, and unlike the elastic regions of the membrane cannot be damaged even if a plunger, pencil-shaped tool, or the like is applied and used to eject the lubricant.

In order to ensure both that the optimum distribution of force is possible for downward pressure and also that the bellows section of the membrane does not move between the edge of the reinforced section and jam, the reinforced section preferably extends essentially across the entire cross section of the lubricant collection chamber.

The housing of the collecting container according to the invention preferably has a cylindrical base body and a smaller-diameter neck connected to the inlet port. In a first embodiment of the invention, the membrane is secured to the end of the inlet port. In particular, provision is made whereby the membrane is attached in the neck and sealed against the housing. Various attachment approaches are possible. For example, the membrane can be welded or glued in place. In addition, the membrane can include a connector piece having a screw thread that is screwed into the neck. Provision is furthermore made whereby the bellows section and the reinforced section of the membrane are sized so that the membrane rests against the inner surface of the housing and lines the interior space of the housing after the collecting container chamber has been filled. As a result, the lubricant that completely fills the lubricant collection chamber is surrounded by the membrane, and the collection chamber is effectively sealed when in the filled condition. Air can escape from inside the housing when the membrane is moved due to the fact that the collection chamber is open at one end.

The arrangement according to the invention enables an inflow pressure of less than 0.2 bar to be sufficient to displace the membrane and fill the space surrounded by the membrane.

At its open end, the housing is provided with at least one stop that limits expansion of the membrane, thereby preventing the membrane from extending beyond a maximum fill condition. The stop can be formed by a projecting lug on the inside face of the housing. It is furthermore possible to provide an arrangement formed by multiple projecting lugs that are spaced apart angularly, or to provide a stop ring.

In a second embodiment of the collecting container according to the invention, the membrane is attached to the end of the housing opposite the inlet port, where the attachment seals off an intermediate space between the housing and the membrane. The housing in this embodiment thus directly forms the lubricant collection chamber, while the membrane the discharge of lubricant on the open end of the housing. Provision is made in this embodiment whereby the membrane is permanently attached to the housing. The membrane can, for example, be permanently welded or glued in place along the edge of the open end of the housing. The membrane is preferably clamped in place between a top edge of the housing and a cover that has a vent.

The reinforced section in both embodiments of the collecting container according to the invention is formed by a dimensionally stable plate—preferably a plastic plate that is permanently attached to the membrane—and, in particular, can also be integrated in the membrane as a core. At least certain regions of the membrane can be of multilayer form, with the reinforcement element laminated or vulcanized between the layers.

In order to improve handling, the reinforced section of the membrane can include a tool seat to allow attachment of an ejection tool. The invention also comprises an approach whereby a cover with an opening or hole is provided on the housing such that an ejection tool can be introduced through the opening of the cover and fitted to the tool seat in order to empty the collecting container. A tool fitted in the tool seat is both adequately supported in the tool seat during the downward-pressing action and is also advantageously guided within the opening of the cover. This ensures that the reinforced section can be pressed down without tilting and cannot jam.

In a development of the collecting container according to the invention, the completely filled collecting container is emptied by compressed air. To this end, a cover including a connection is provided on the housing so as to enable a compressed air source to be connected, the cover being mounted on the housing in a pressure-resistant manner.

BRIEF DESCRIPTION OF THE DRAWING

The following describes the invention with reference to illustrated embodiments. Therein.

SPECIFIC DESCRIPTION OF THE INVENTION

Figure 1:
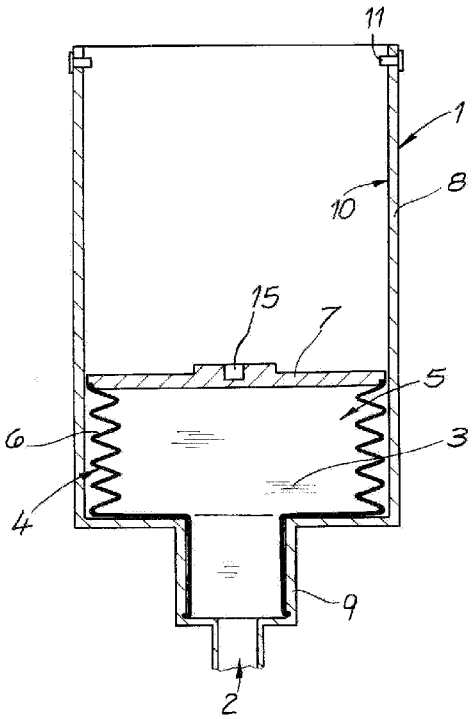
FIG. 1 shows a collecting container in a partially filled condition based on a first embodiment of the invention.

The collecting container for lubricants as illustrated in FIGS. 1 through 4 comprises a housing 1 that is formed with an inlet port 2 enabling lubricant 3 to enter, and is open on the opposite end. A flexible membrane 4 is attached to the housing 1 of the collecting container and forms a lubricant collection chamber 5 connected to the inlet port 2 in the housing 1. Starting from its attachment on the housing 1, the membrane 4 first of all has a bellows 6 and then a reinforced section 7 connected to its end.

FIG. 1 clearly shows that reinforced section 7, which is in the form of a dimensionally stable plate, essentially extends across the entire cross section of the lubricant collection chamber 5. The bellows 6 of the membrane has a plurality of folds that are created with a predefined geometry. The membrane 4 is secured in place both to the end wall of the inlet port 2 and to the reinforced section 7. Clearly shown is the fact that the housing 1 has a cylindrical base body 8 and a smaller-diameter neck 9 connecting to the inlet port 2. It is evident that the membrane 4 in the neck 9 is attached, for example, by a screw thread, not shown here, and is sealed against the housing 1. The inlet port 2 in the bottom of the housing 1 can include a screw thread enabling it to be attached to a lubricant discharge of an unillustrated lubricant system.

Figure 2:
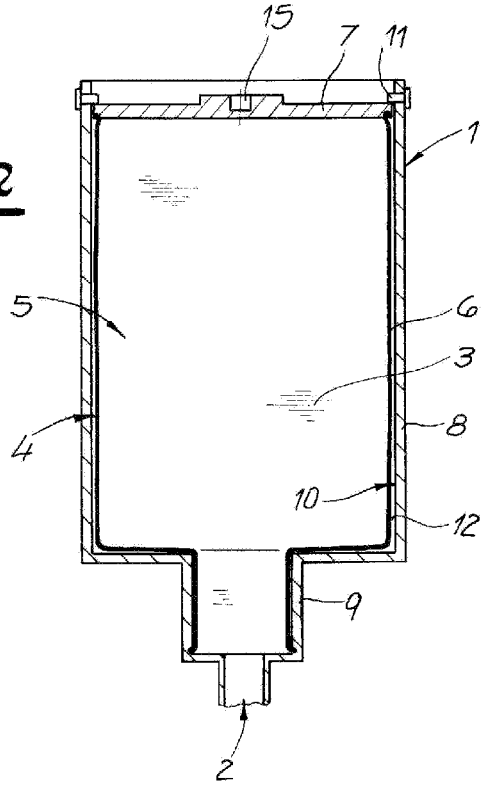
FIG. 2 shows the container of FIG. 1 in the filled condition.

Based on the filled condition of the lubricant collection chamber as shown in FIG. 2, it is evident that the bellows 6 and the reinforced section 7 of the membrane 4 are sized so that the membrane 4 rests against an inside surface 10 of the housing 1 and lines the interior space of the housing 1. The membrane surrounds the lubricant collection chamber 5.

Expansion of the elastic membrane 4 is limited by at least one stop 11 at the open upper end of the housing 1 opposite the inlet port 2. The reinforced section 7 of the membrane 4, which is formed by a dimensionally stable plate, comes into contact with the projecting lug 11 in the filled condition as shown here.

Figure 3:
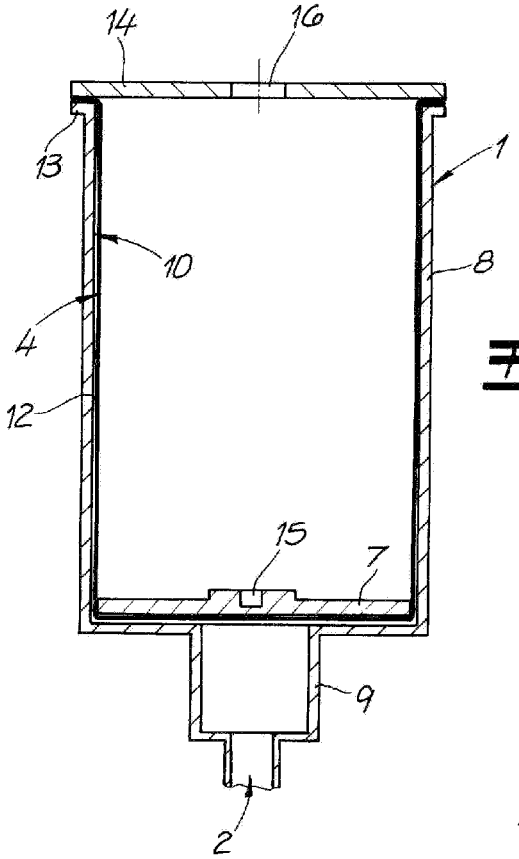
FIG. 3 shows a collecting container in an empty condition according to another embodiment of the invention.
Figure 4:
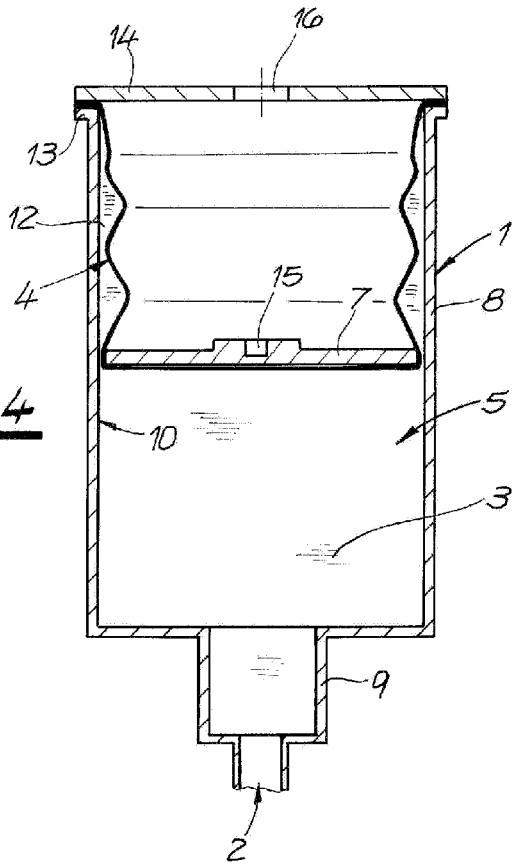
FIG. 4 shows the collecting container of FIG. 3 in the filled condition.

The second embodiment of the lubricant collection chamber as shown in FIGS. 3 and 4 also includes the housing 1 having a cylindrical base body 8 and a smaller-diameter neck 9 connected to the inlet port 2. As the figures show, the membrane 4 is attached to the end of the housing 1 opposite the inlet port 2, where the attachment seals off an intermediate space 12 between the housing 1 and the membrane 4. The membrane 4 is preferably permanently attached to the housing 1. This is achieved, for example, by a weld or glued joint. In particular, the membrane, as shown in FIGS. 3 and 4, can be clamped in place between a top edge 13 of the housing 1 and a cover 14.

FIGS. 3 and 4 show that the cover 14 on the housing 1 is formed with an opening or throughgoing hole 16. In order to empty the filled collecting container, the reinforced section 7 has a tool seat 15 to which an ejection tool can be fitted. The ejection tool can be inserted through the opening 16 of cover 14 into the collecting container and inserted into tool seat 15. The reinforced section 7 can be pressed down by the tool in order to expel lubricant 3 from the lubricant collection chamber 5.

The invention claimed is:

1. A collecting container for lubricants, comprising:

a housing having an open end and an opposite end and formed on the opposite end with an inlet port for receiving lubricant;

a cover secured over the open end and having a throughgoing hole; and a flexible membrane attached to the housing and delimiting in the housing a lubricant collection chamber into which the inlet port opens, the membrane having a bellows section and a reinforced section connected thereto and formed with a tool seat aligned with the hole, whereby an ejection tool can engage through the hole and fit in the seat.

2. The collecting container according to claim 1, wherein the reinforced section extends essentially across an entire cross section of the lubricant collection chamber.

3. The collecting container according to claim 1, wherein the membrane is secured to the opposite end at the inlet port.

4. The collecting container according to claim 3, wherein the housing has a cylindrical body and a smaller-diameter neck that fits in the inlet port, the membrane being attached to the housing at the neck and there sealed against the housing.

5. The collecting container according to claim 1, wherein the bellows section and the reinforced section of the membrane are sized so that the membrane rests against an inside surface of the housing and lines the housing after the lubricant collection chamber has been filled.

6. The collecting container according to claim 1, wherein the housing has on the open end at least one stop that limits expansion of the membrane.

7. The collecting container according to claim 1, wherein the membrane is attached to the open end of the housing so as to seal off an intermediate space between the opposite end of the housing and the membrane.

8. The collecting container according to claim 7, wherein the membrane is clamped in place between a top edge of the housing and the cover.

9. The collecting container according to claim 1, wherein the reinforced section is formed by a dimensionally stable plate.

10. The collecting container according to claim 1, wherein the reinforced section is integrated as a core in the membrane.

11. The collecting container according to claim 4, wherein the body and membrane are centered on an axis and the inlet, seat, and hole are aligned along the axis.

* * * * *